US006421891B2

(12) United States Patent
Bartkowiak et al.

(10) Patent No.: US 6,421,891 B2
(45) Date of Patent: Jul. 23, 2002

(54) APPARATUS FOR PROCESSING AND WINDING A YARN

(75) Inventors: Klaus Bartkowiak, Herne; Peter Dammann, Remscheid, both of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/801,065

(22) Filed: Mar. 7, 2001

Related U.S. Application Data

(63) Continuation of application No. PCT/EP99/06388, filed on Aug. 31, 1999.

(30) Foreign Application Priority Data

Sep. 10, 1998 (DE) ..... 198 41 320

(51) Int. Cl.[7] ..... D02G 1/20
(52) U.S. Cl. ..... 28/258; 28/271
(58) Field of Search ..... 28/250, 251, 256, 28/258, 262, 255, 263, 219, 217, 220, 221, 247, 248, 249, 254, 257

(56) References Cited

U.S. PATENT DOCUMENTS 3,944,166 A * 3/1976 Hermanns ..... 57/261
5,105,613 A * 4/1992 Zott et al. ..... 57/261
5,339,502 A * 8/1994 Grossenbacher et al. ..... 57/261
5,469,609 A * 11/1995 Beifuss ..... 57/261

FOREIGN PATENT DOCUMENTS

DE 2255443 * 5/1974 ..... 57/261
DE 3908463 * 9/1990 ..... 57/261
FR 2380972 * 9/1978 ..... 57/261

* cited by examiner

*Primary Examiner*—Danny Worrell
(74) *Attorney, Agent, or Firm*—Alston & Bird LLP

(57) ABSTRACT

A yarn texturing machine for texturing and winding a yarn, wherein the feed system withdraws the yarn from a texturing device and advances it to a takeup device. Between the feed system and the takeup system, a yarn accumulation or free space is provided for the purpose of receiving the yarn that has slackened during a package doff due to an overfeed. To withdraw the yarn reliably from the feed system, a conveying nozzle is positioned between the feed system and the free space, and the conveying nozzle includes at least one nozzle bore that is directed in the direction of the advancing yarn, so that an air stream directed through the bore toward the yarn generates a tension on the yarn in the direction of its advance. Subsequently, the yarn is blown into the free space.

20 Claims, 8 Drawing Sheets

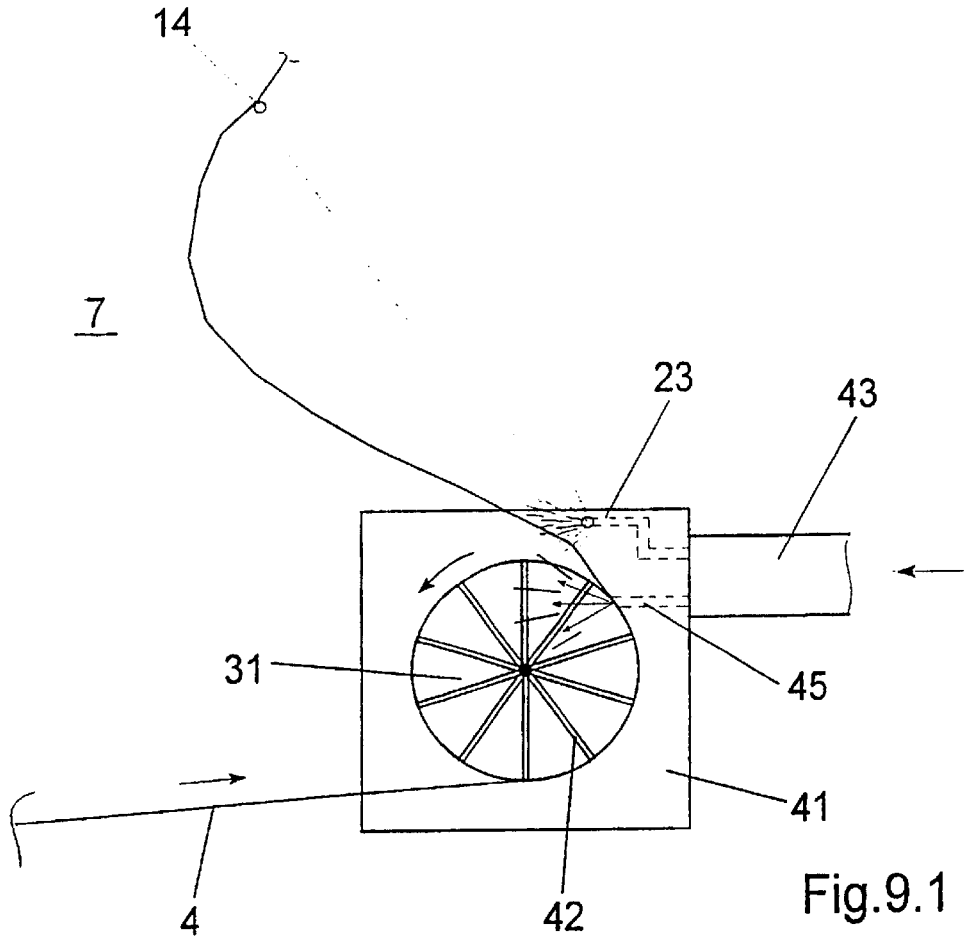
Fig.9.1
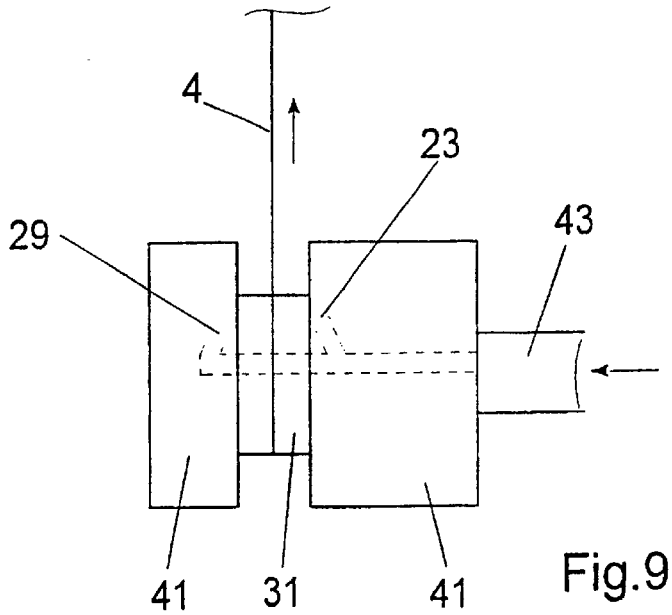
Fig.9.2

APPARATUS FOR PROCESSING AND WINDING A YARN

CROSS REFERENCE TO RELATED APPLICATION

This is a continuation of international application No. PCT/EP99/06388, filed Aug. 31, 1999, and designating the U.S.

BACKGROUND OF THE INVENTION

The present invention relates to a yarn processing machine for processing and winding an advancing yarn, and more specifically, to a yarn texturing machine of the type disclosed in EP 0 633 213.

The known texturing machine comprises a texturing device and a takeup device. In this machine, a feed system withdraws the yarn from the texturing device and advances it to the takeup device. In the takeup device, the yarn is wound to a package. In particular in machine types with an automatic package doff, time phases occur with a momentary yarn overfeed in the feed system upstream of the takeup device, since the takeup device receives the yarn at a regular speed only during the winding time. As soon as the yarn is removed for purposes of preparing the package doff from a traversing device that reciprocates the yarn in the takeup device, the advancing speed adjusted by the feed system is often greater than the receiving speed of the takeup device. During a package doff, a so-called tie-off bead is wound, after the yarn has been lifted out of the traversing system. Subsequently, the yarn is cut and taken over by a suction device. In this instance, the receiving speed of the takeup device is dependent on the receiving capability of the suction device. In the phases, during which the receiving speed of the takeup device is less than the advancing speed of the feed system, an overfeed of the yarn occurs, which leads to a slack in the yarn between the takeup device and the feed system.

To avoid the formation of laps on the feed system, a yarn accumulator for receiving the slack yarn is used in the known texturing machine. In this connection, the yarn accumulator is arranged in the direction of the advancing yarn directly downstream of the feed system. Consequently, there is a risk that a slack in the yarn, which forms when there is a difference between the advancing speed of the feed system and the receiving speed of the takeup device, propagates to the feed system and leads to the formation of laps due to electrostatic effects.

It is therefore an object of the invention to further develop the texturing machine of the initially described kind such that the slack in the yarn as occurs during a package doff is reliably accumulated. A further object of the invention is to assist the package doff in such a manner that the yarn can be reliably taken over by the suction device during the doffing phase.

SUMMARY OF THE INVENTION

The above and other objects and advantages of the present invention are achieved by the provision of a yarn processing apparatus which includes a yarn processing device, such as a texturing device, through which the yarn is advanced. A feed system withdraws the advancing yarn from the processing device and conveys the yarn to a takeup device, and a yarn conveying nozzle is located between the feed system and the takeup device. The yarn conveying nozzle generates an air stream which engages the advancing yarn with a component of movement extending in the direction of the advancing yarn, so that the air stream generates a tension on the yarn upstream of the yarn conveying nozzle and causes an accumulation of slack to be formed in a free space positioned downstream of the yarn conveying nozzle.

The invention is distinct from the apparatus disclosed in DE 22 54 736, wherein a yarn is injected directly upstream of a takeup device into a chamber arranged laterally of the yarn by means of an injection nozzle opposite to the chamber. The relatively strong deflection, that is increased by yarn guides on the lower and upper chamber walls, causes the yarn to be held under tension by the looping friction between the takeup device and the chamber. This effect is contrary to the invention. In the texturing machine of the present invention, a tension is generated on the yarn in its direction of advance. With that, a slack in the yarn toward the takeup device is possible. During the package doff, this slack is desired for purposes of assisting in the transfer of the yarn from the fully wound package to the suction device. This all the more, since greater looping frictions on the yarn could result in that the suction device does not engage the yarn or is unable to hold it. Thus, the invention shows a way of temporarily storing a slack yarn between the feed system and the takeup device without significantly increasing the looping friction and without a risk of lap formation.

Besides the conveying effect, the conveying nozzle is able to lead to a deflection of the slack yarn. In this connection, it has shown that it is favorable to arrange the nozzle bore of the conveying nozzle at an angle less than about 30°, preferably less than about 20°.

The conveying nozzle may include a second nozzle bore which is arranged with the first bore to define a plane which intersects or contains the advancing yarn, and to also define an angle which is bisected by the advancing yarn when viewed in a direction perpendicular to the plane. This construction causes a high tension to be generated on the yarn. At the same time, the arrangement of two opposite nozzle bores facilitates a relatively smooth advance of the yarn despite the air stream. In this connection, it is preferred to arrange the nozzle bores relative to each other such that their center axes form an angle less than about 60°, preferably less than about 40°, which is bisected by the advancing yarn.

In the production of a textured yarn, the yarn tension in the apparatus of the present invention remains unchanged in the zones upstream of the feed system during the package doff. The yarn delivered by the feed system is withdrawn under tension. This effect is supported in particular by the further development of the invention wherein a rotatably driven conveying roll is positioned in the yarn path upstream of the conveying nozzle, such that the yarn partially loops about its circumference. A conveying roll upstream of the conveying nozzle causes the yarn tension to be increased toward the feed system according to the Eitelwein law ($F_1=F_o*e^{i*a}$). Between the feed system and the conveying roll, no slack occurs in the yarn. The conveying nozzle blows the yarn into the free space. In so doing, the yarn forms, for example, a loop in the air.

Thus, the conveying effect of the conveying nozzle $F_0$ is increased up to the factor $e^{i*a}$. In this connection, it is advantageous to operate the conveying roll by a turbine drive or an electric drive, so that the circumferential speed is greater than the yarn speed.

With the use of a turbine drive, the conveying roll and conveying nozzle can advantageously be combined into one unit wherein the nozzle bores are formed directly downstream of the point of departure of the yarn from the conveying roll. The turbine drive and the nozzle bore are supplied by a common compressed air supply.

In one embodiment of the conveying nozzle, the yarn is guided in a conveying gap, which is defined by two opposite sidewalls. One of the sidewalls accommodates one or two nozzle bores that terminate in the conveying gap. With that, the air stream is directed to the yarn in a concentrated manner. This construction of the apparatus in accordance with the invention is especially suitable for use inside the traversing triangle in a takeup device. The conveying gap formed transversely of the yarn advance offers the possibility of performing unhindered a transverse movement that is necessitated by the yarn traversing device, when the yarn is wound on a package. The air stream of the conveying nozzle is activated only at the start of the package doff.

To convey the yarn into the free space for receiving the slack, the yarn is guided along the sidewall which opposes the opening of the nozzle bore.

To deflect the yarn at the outlet of the conveying nozzle in a purposeful manner, it is proposed to arrange a guide plate in the extension of the sidewall which opposes the opening of the nozzle bore. The shape of the guide plate permits deflecting the air stream exiting from the conveying gap according to the laws of flow (Coanda effect). Therefore, in particular a guide plate curved in direction toward the free space results in that the air stream exiting from the conveying gap is deflected in a concentrated manner into the free space and leads to the deflection of the yarn.

To receive a yarn, in the event of a great difference between the receiving speed of the takeup device and the advancing speed of the feed system, it is desirable to utilize a bounce plate which defines the free space. In this instance, the slack yarn is accumulated within the free space on the bounce plate in the form of loops and coils. After the package is doffed, and the receiving speed of the takeup device is substantially greater than or equal to the advancing speed of the feed system, the accumulated yarn will be removed.

Since the slack in the yarn occurs only for a very short time during the package doff, the conveying effect of the conveying nozzle is likewise needed only for a short time. To this end, it would be possible to construct the conveying nozzle for movement, so that the yarn comes into the effective range of the nozzle only during a package doff. However, it would also be possible to mount the conveying nozzle stationarily inside the machine. In any event, it is preferred to activate the compressed air supply only during the package doff.

BRIEF DESCRIPTION OF THE DRAWINGS

In the following, several embodiments are described in more detail with reference to the attached drawings, in which:

FIGS. 9.1 and 9.2 show a conveying roll with an integrated conveying nozzle.

DETAILED DESCRIPTION OF THE PREFERRED EMBODIMENTS

Figure 1:
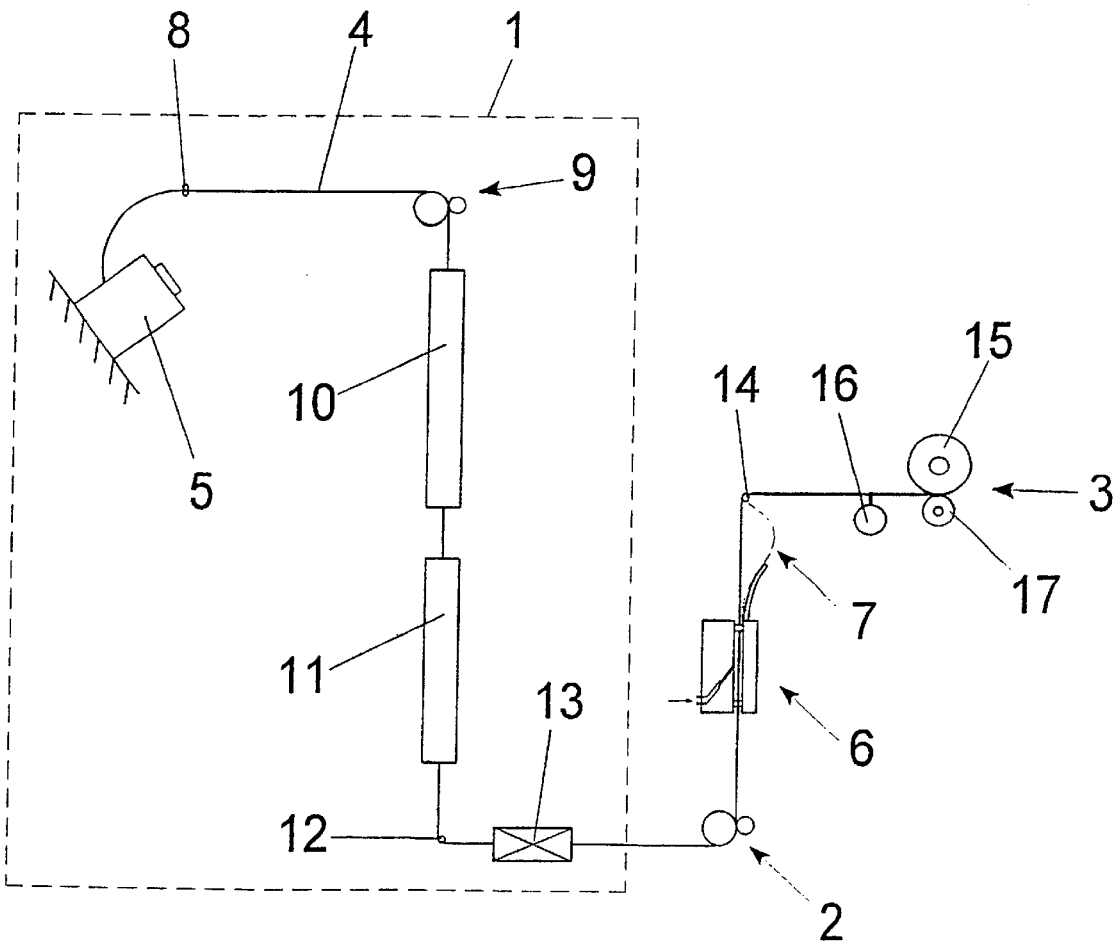
FIGS. 1–3 are schematic views of a first embodiment of the texturing machine according to the invention.
Figure 2:
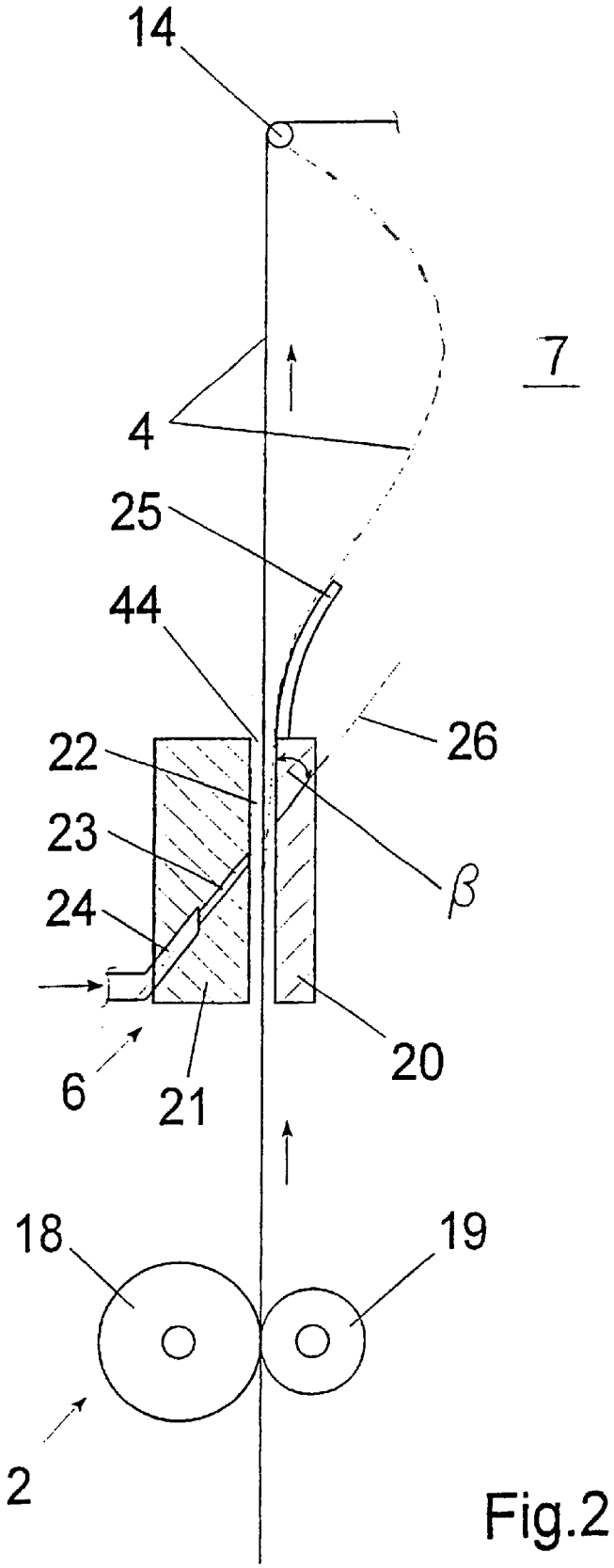
Figure 3:
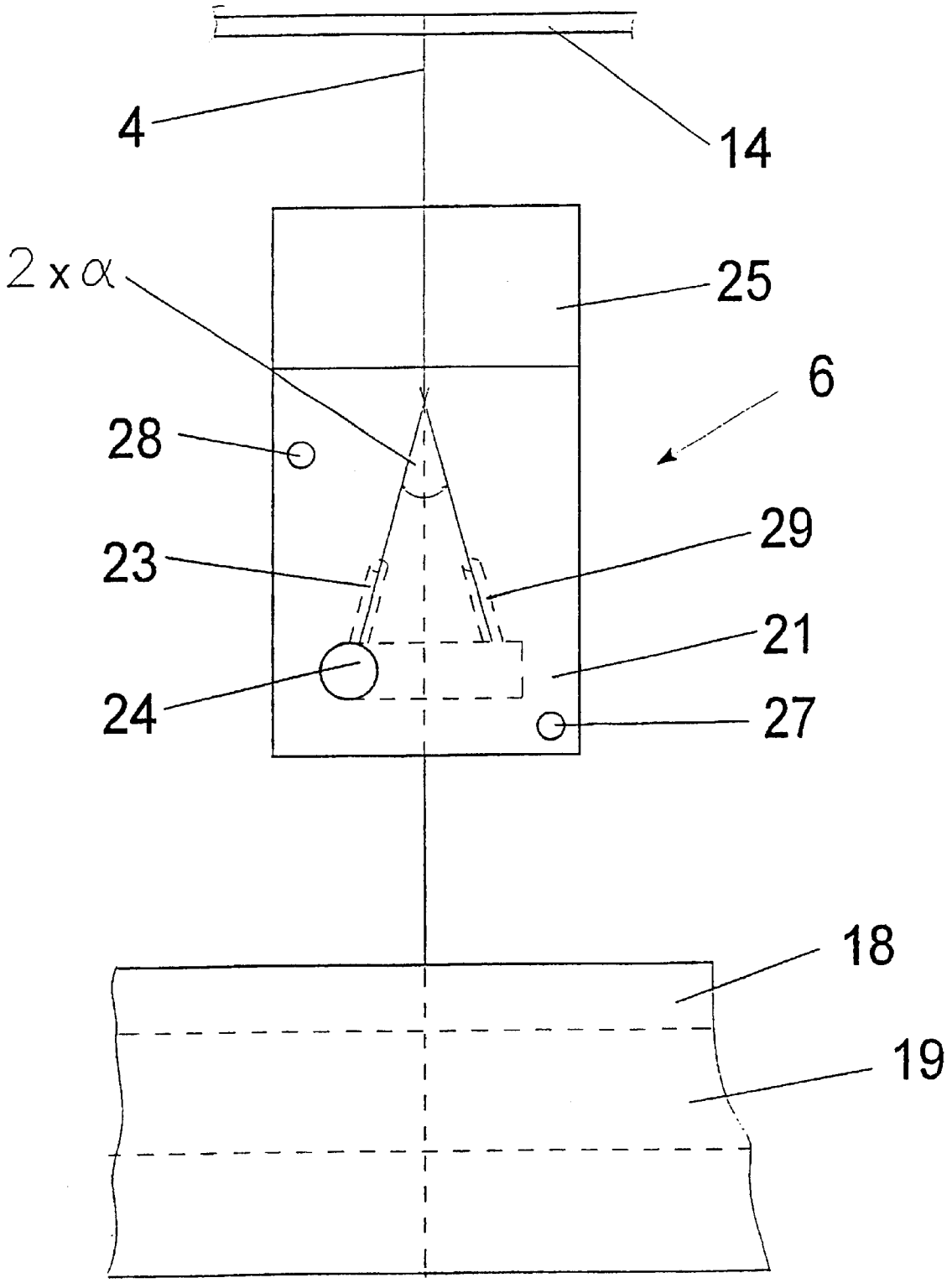

FIGS. 1–3 illustrate a first embodiment of a texturing machine according to the invention, with FIGS. 2 and 3 being each a cutout view of the machine shown in FIG. 1. Thus, the following description applies to FIGS. 1–3 alike.

The texturing machine comprises a texturing device 1. Inside this device, a feed system 9 withdraws a yarn 4 via a yarn guide 8 from a feed yarn package 5. The feed system 9 advances the yarn 4 into a texturing zone. The texturing zone is formed between a false twist unit 13 and the feed system 9. The texturing zone accommodates a heating device 10 and a cooling device 11 that are arranged one after the other in the path of the yarn. The false twist unit 13 imparts to the yarn a false twist that returns at least to the heating device 10. In the heating device 10 and the cooling device 11 downstream thereof, the texturing in the yarn is set.

Subsequently, a feed system 2 withdraws the yarn from the texturing device 1 and advances it to a takeup device. The takeup device 3 consists of a package 15 and a friction roll 17. The friction roll 17 lies against the circumference of the package 15 and drives the package 15 at a constant circumferential speed. In the yarn path upstream of the package 15, a yarn traversing device 16 is arranged, which reciprocates the yarn substantially transversely to the yarn path, so the yarn is uniformly deposited on the package surface.

Between the feed system 2 and the takeup device 3, a conveying nozzle 6 is arranged in the path of the yarn. FIG. 2 is a cross sectional view of the conveying nozzle 6. The conveying nozzle 6 consists of two sidewalls 20 an 21. The sidewalls 20 and 21 form between them a conveying gap 22, through which the yarn 4 advances. The sidewall 21 accomodates two nozzle bores 23 and 29 (see FIG. 3) in such a manner that they terminate with their one end in the conveying gap 22. At their opposite end, the nozzle bores 23 and 29 connect to a supply line 24. The nozzle bores 23 and 29 terminate in the conveying gap at an angle $\beta$ between the center axis 26 of the nozzle bore and sidewall 20, note FIG. 4. The angle $\beta$ is less than about 30°, preferably less than about 20°.

At the outlet 44 of the conveying nozzle, a guide plate 25 extends from the sidewall 20. The guide plate 25 has a curved shape that is directed away from the yarn path.

Between the outlet 44 of conveying nozzle 6 and a deflection bar 14, a free space 7 is formed directly upstream of the takeup device 3.

The feed system 2 consists of a feed shaft 18 and a pressure roll 19 lying against the circumference of the feed shaft 18. The feed shaft 18 connects to a drive. For advancing the yarn 4, same is nipped between the feed shaft 18 and pressure roll 19. The rotation of the feed shaft 18 with freely rotatable pressure roll 19 causes the yarn 4 to advance at the circumferential speed of the feed shaft 18.

FIG. 3 is a front view of conveying nozzle 6. The nozzle bores 23 and 29 are shown in phantom lines. In the sidewall 21, the nozzle bores 23 and 29 are arranged, preferably in one plane. Their center axes enclose an angle $2\alpha$. Advantageously, the intersection of the center axes coincides with the yarn path in conveying gap 22. The angle $2\alpha$ is less than about 60°, preferably less than about 40°, with the yarn advantageously representing the angle bisector. The sidewalls 21 and 20 of conveying nozzle 6 are interconnected via pin 27 and 28. The pins may be threaded, so that the width of the conveying gap can be adjusted at the same time.

In the embodiment shown in FIGS. 1–3, the yarn 4 is first continuously wound to a package 15. The winding speed or the receiving speed of the takeup device 3 is in this instance equal to the delivery speed or greater than the delivery speed of feed system 2. In this phase, the yarn 4 advances through the conveying nozzle in a straight line to the deflection bar 14. After the package 15 is fully wound, the package is doffed. To this end, it is necessary to lift the yarn 4 first out of the traversing device 16. For a short time, the yarn is wound on the package 15 to a so-called tie-off bead. After winding the tie-off bead, the yarn 4 is cut by a device not shown and removed by suction. Now, the full package 15 is replaced with an empty tube. In this phase, the winding speed of the yarn in the takeup device 3 is less than the advancing speed of the feed system 2. Thus, the feed system 2 causes the yarn 4 to be overfed. In the conveying nozzle 6, the yarn 4 is subjected to an air stream generated by nozzle bores 23 and 29. As a result of the configuration of nozzle bores 23 and 29, the direction of blowing is oblique relative to the direction of the advancing yarn. This allows generating a tension on the yarn in its direction of advance. The guide plate 25 causes the flow at the outlet of the conveying gap to be deflected in the direction of free space 7, so that in the instance of overfeeding, the yarn is guided as a loop in the air (shown in phantom lines). Thus, the excessive amount of yarn is received in free space 7.

Figure 4:
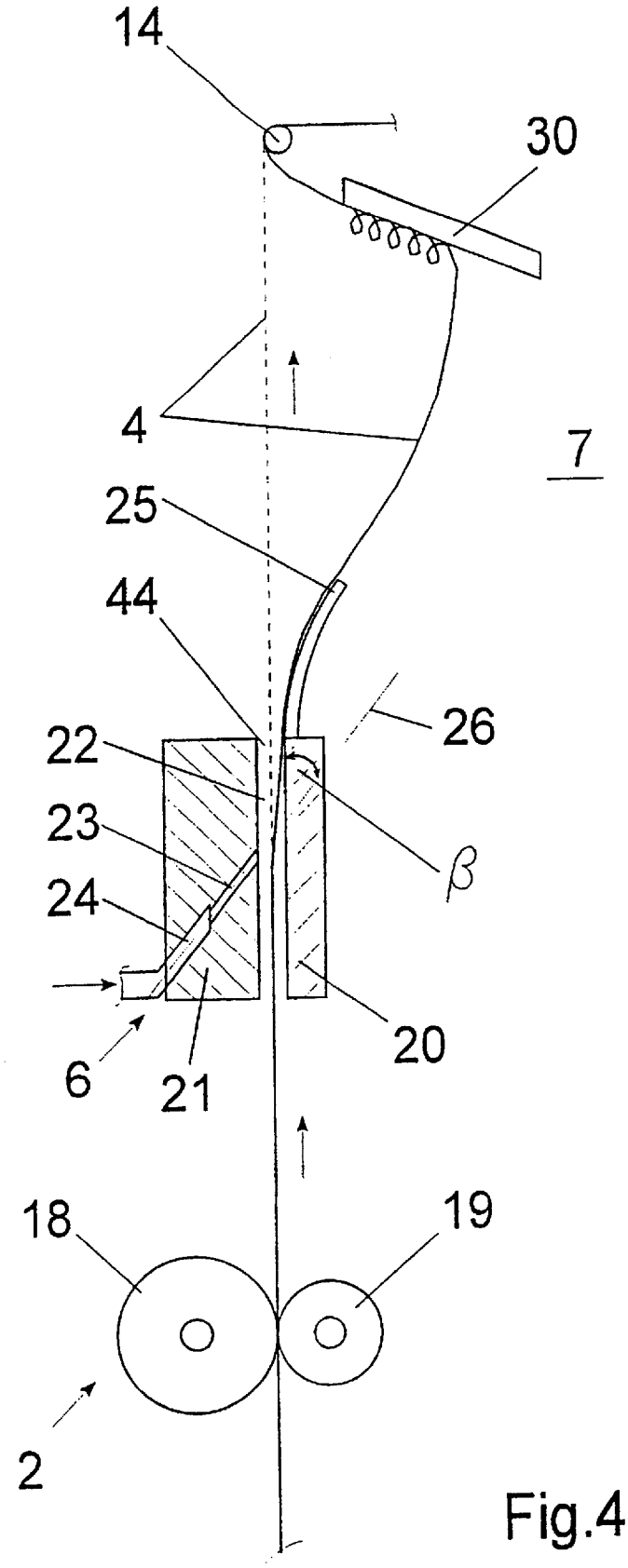
FIG. 4 shows an embodiment of a conveying nozzle with a bounce plate.

FIG. 4 shows a further embodiment of the apparatus according to the invention. This embodiment shows only a section of the machine, which is relevant to the invention. The conveying nozzle 6 is constructed, as has previously been described with reference to FIGS. 1–3. To this extent, the description of FIGS. 1–3 is herewith incorporated by reference. Furthermore, structural parts having the same function are identified in the following embodiments by like numerals. In the embodiment shown in FIG. 4, the free space 7 is bounded by a bounce plate 30. In this connection, the blowing effect of conveying nozzle 6 blows the slack yarn into the free space 7, until the yarn 4 impacts upon the bounce plate 30. On the bounce plate 30, the yarn will deposit in the form of loops or coils. After completion of the package doff, the yarn tangle becomes again undone by the action of the winding speed. This arrangement is especially suited for receiving a strong overfeed of feed system 2.

Figure 5:
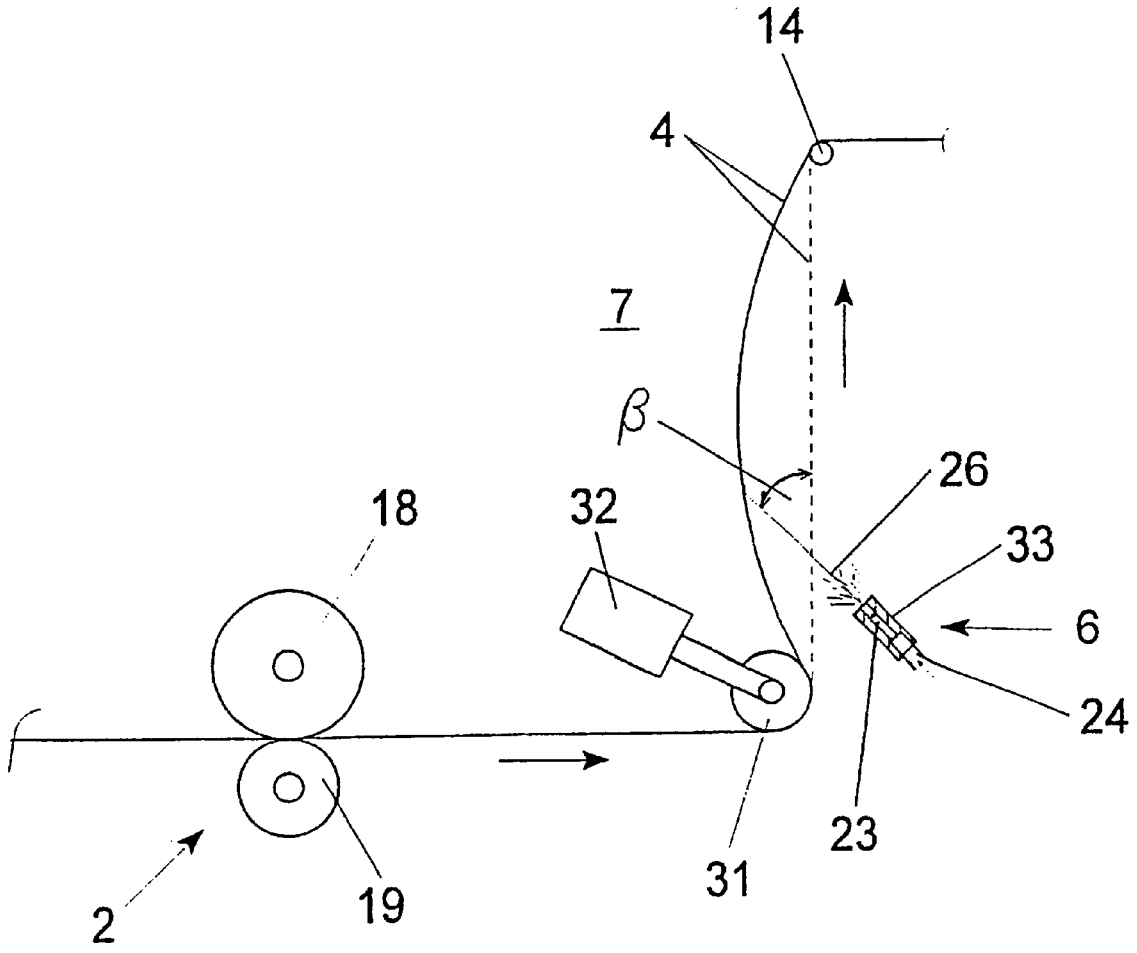
FIG. 5 shows an embodiment of a conveying nozzle with a conveying roll upstream thereof.

FIG. 5 illustrates a further embodiment, as may be used in the machine of FIG. 1. In this embodiment, the feed system 2 withdraws the yarn 4 from a texturing device and advances it to the takeup device not shown. The feed system 2 comprises the feed shaft 18 and pressure roll 19. Between the feed system 2 and the deflection bar 14, a conveying roll 31 extends in the path of the yarn. In this arrangement, the yarn partially loops about the circumference of conveying roll 31. FIG. 5 shows a deflection of about 90°. The conveying roll 31 is driven by means of a drive 32. In the path of the yarn, the conveying roll 31 is followed by conveying nozzle 6. In this arrangement, the conveying nozzle [roll] 6 is located laterally of the yarn path opposite to the conveying roll 31. The conveying nozzle consists of a housing 33. The housing 33 accommodates a nozzle bore 23, which connects to the supply line 24. A pressure medium is supplied to the conveying nozzle 6 via supply line 24. The conveying nozzle 6 is arranged such that the air stream generated by nozzle bore 23 generates a transverse force on the yarn, which has an essential component in the direction of advance. Thus, when the yarn 4 is overfed, it is blown into the free space 7. This generates in the yarn length advancing from conveying roll 31 a tension ($F_o$), which leads in the yarn length between the conveying roll 31 and feed system 2, due to the looping friction on the conveying roll 31, to a tension ($F_1$) correspondingly increased under the laws of friction. Thus, the drive of the conveying roll 31 causes the tension to increase between the conveying roll 31 and the feed system 2 by the factor $e^{\mu^* a}$ ($F_1 = F_0 * e^{\mu^* a}$), when the conveying roll 31 drivingly overtakes the yarn. Thus, the overfeed of the yarn 4 occurs only downstream of the conveying roll 31 in the region of free space 7. The conveying roll 31 may be driven, for example, by an electric motor or by a turbine drive actuated by compressed air.

The conveying nozzle 6 is arranged relative the yarn path such that the center axis 26 of the nozzle bore 23 forms with the yarn path an angle β. The angle β is less than about 30°, preferably less than about 20°. This ensures that the longitudinal force generated by the air stream produces an adequate conveying effect on the yarn for receiving the overfeed.

In the embodiment shown in FIG. 5, the blowing direction and the free space 7 are configured relative the deflection bar 14 such that a slack yarn 4 has a lesser looping on deflection bar 14. With that, the looping friction is further decreased, so as to assist during a package doff in the takeover of the yarn end by a suction device.

Figure 6:
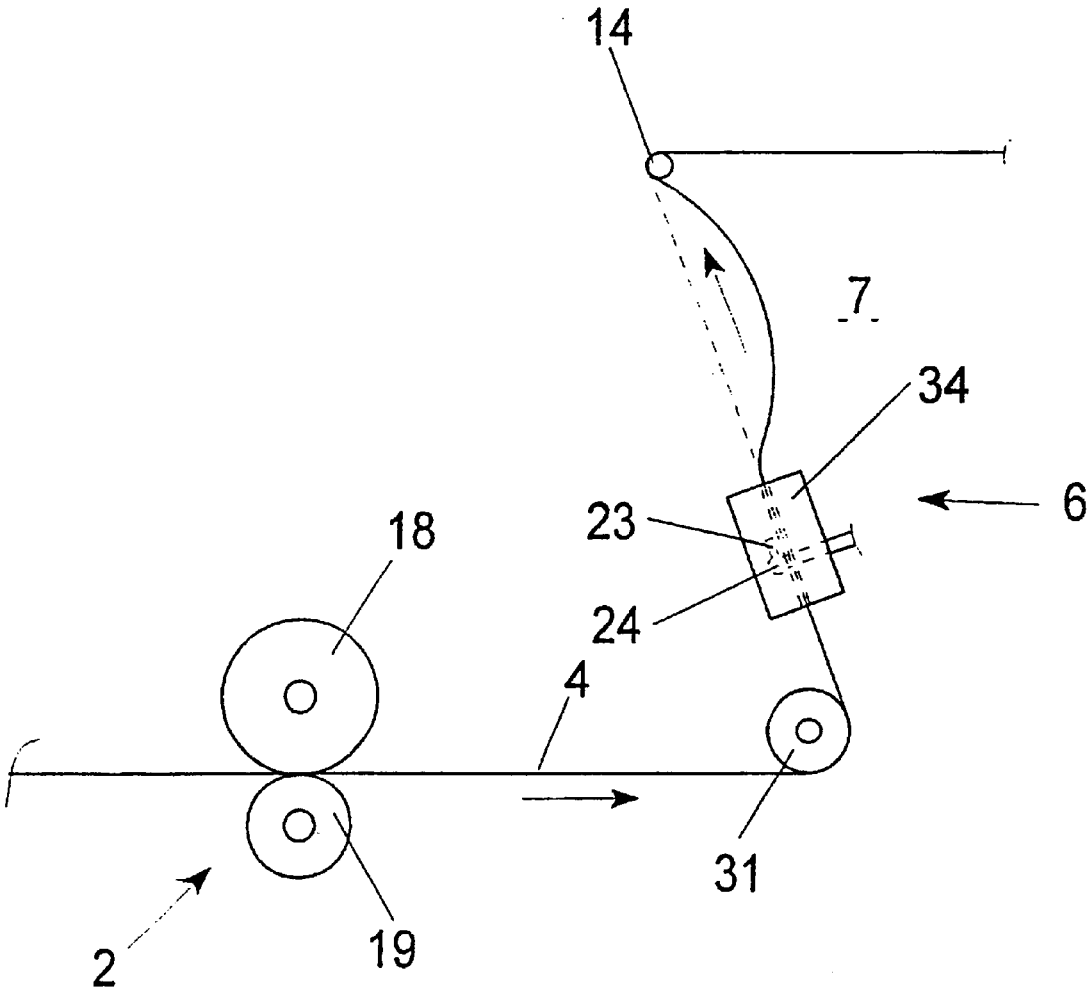
FIGS. 6–8 show a further embodiment of a conveying nozzle with a conveying roll upstream thereof.
Figure 7:
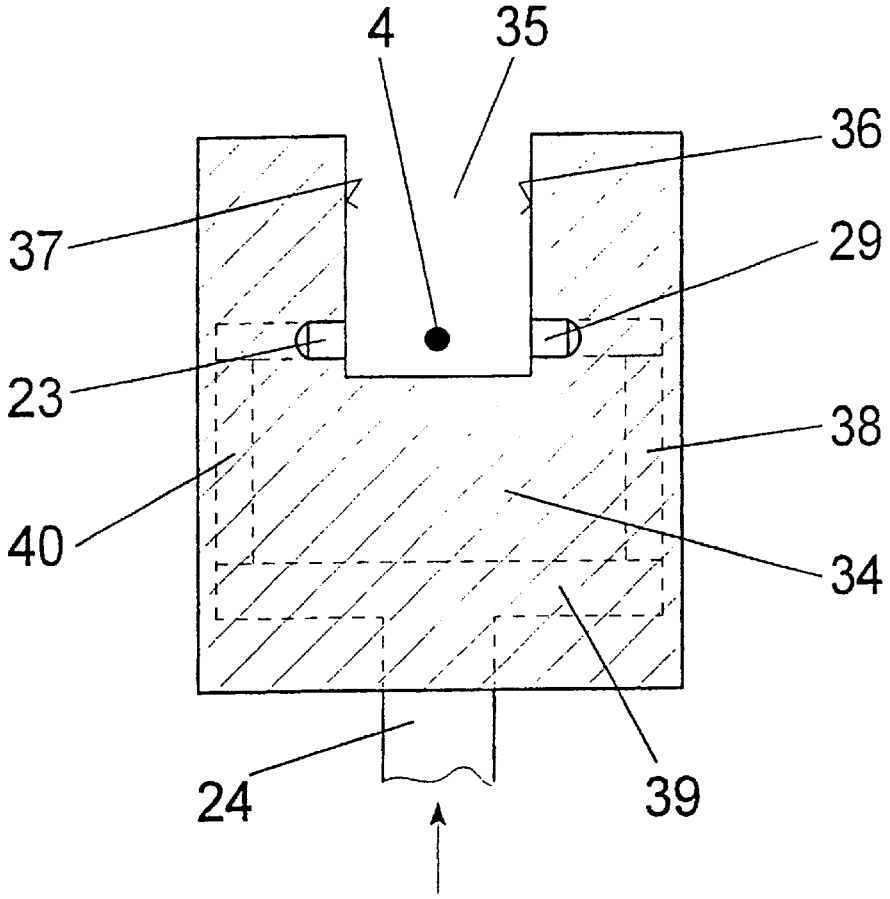
Figure 8:
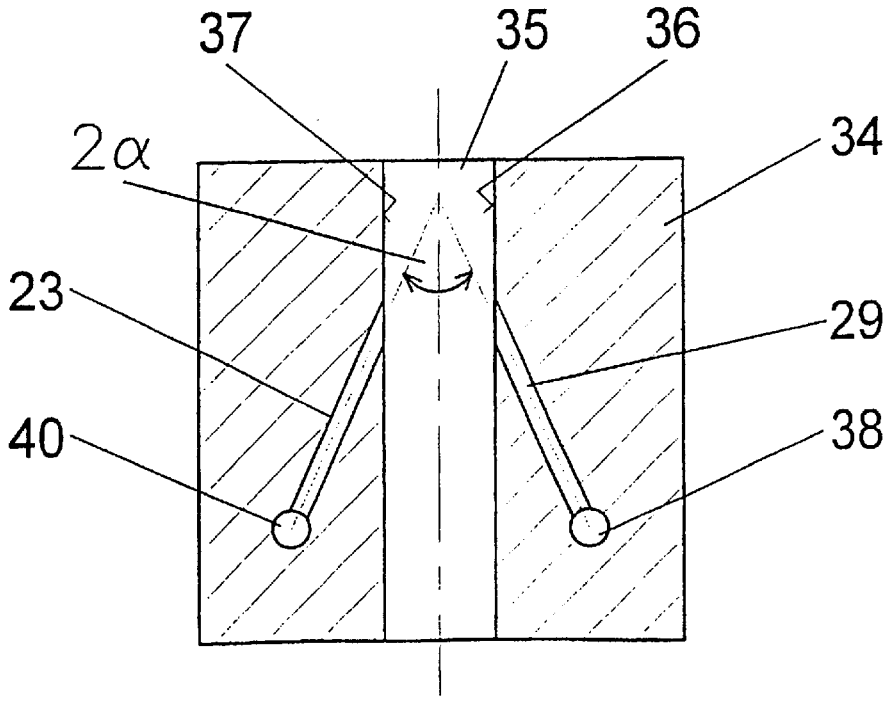

FIGS. 6–8 show a further embodiment, as could be used in the machine of FIG. 1. In this embodiment, a nondriven conveying roll 31 and a conveying nozzle 6 extend between the feed system 2 and deflection bar 14. FIG. 7 is a cross sectional view of the conveying nozzle 6, and FIG. 8 is an axially sectioned view of the conveying nozzle 6. Therefore, the description applies to FIGS. 6, 7, and 8 alike.

The conveying nozzle 6 consists of a housing 34. In the housing 34, a groove-type yarn channel 35 is formed. The yarn channel 35 comprises essentially two parallel channel walls 36, 37. The yarn 4 advances through the yarn channel 35 in the longitudinal direction. The channel walls 36 and 37 accommodate the nozzle bores 23 and 29. They terminate in the yarn channel 35 such that an angle $2*\alpha$ of less than about 30°, preferably less than about 20° is adjusted. The mouth of nozzle bores 23 and 29 is directed in the direction of the advancing yarn. Via bores 38, 39, 40, the nozzle bores 23 and 29 connect to supply line 24.

The nozzle bores 23 and 29 extend in one plane.

In this embodiment of conveying nozzle 6, the air stream enters yarn channel 35 via nozzle bores 23 and 29. By the yarn channel 35, the air stream is concentrated, and it generates on the yarn a relatively high tension, thereby driving the roll 31 that is looped by the yarn. Due to the looping friction and the bearing friction of roll 31, the yarn tension that is effective between the feed system 2 and the roll 31, is smaller than the tension generated by the conveying nozzle 6. During an overfeed of the yarn, same is blown into the free space 7 after leaving the yarn channel 35.

FIGS. 9.1 and 9.2 illustrate a further embodiment of a conveying nozzle with a conveying roll, as could be used, for example, in the machine of FIG. 1. In this connection, FIG. 9.1 is a cross sectional view and FIG. 9.2 a front view of the conveying roll. At its two ends, the conveying roll 31 is rotatably supported in a drive housing 41. In the drive housing 41, a turbine drive connects to conveying roll 31. To this end, the conveying roll 31 comprises a plurality of turbine blades 42. The drive of the turbine, via its blades 42, occurs by a compressed-air jet from a nozzle bore 45 that is supplied by a compressed-air supply 43. In the drive housing 41, a nozzle bore 23 and 29 are arranged each on one side of the yarn 4. The nozzle bores 23 and 29 receive compressed air from a compressed-air supply 43. The nozzle bores 23 and 29 extend in the region of drive housing 41, in which the yarn has just left conveying roll 31. During an overfeed of yarn 4, the conveying roll 31 and the air stream on the outlet side of the conveying nozzle advance the yarn 4 directly into an adjoining free space 7.

In each of the illustrated embodiments, the conveying nozzle is stationarily arranged. However, it is also possible to construct the conveying nozzles for movement. In this case, the conveying nozzle swings into the yarn path only in the phase of the package doff, and subjects the yarn to an air stream.

In the illustrated embodiments, it is advantageous to activate the air stream of the nozzle only in the phase of the package doff. However, it is also possible to apply an air stream constantly to the yarn. In this instance, it may be advantageous to add a liquid to the air stream for treating the yarn. Furthermore, it may also be advantageous to operate the conveying nozzle with a gas.

Basically, it will be possible to combine each conveying nozzle 6 with a conveying roll 31, if it is intended to reach a high yarn tension downstream of feed system 2.

At this point, it should also be pointed out that the texturing machine shown in FIG. 1 is exemplary in its construction. Thus, the texturing device could comprise in addition a second heater with a preceding feed system for an aftertreatment of the yarn. Likewise, it would be possible to arrange an entanglement nozzle upstream of the takeup device for removing a residual twist in the yarn.

What is claimed is:

1. A yarn processing apparatus comprising a yarn processing device through which the yarn is advanced, a feed system for withdrawing the advancing yarn from the processing device and conveying the yarn along a normal path of travel to a takeup device, a yarn conveying nozzle located along the normal path of travel between the feed system and the takeup device and comprising at least one nozzle bore for generating an air stream which engages the advancing yarn and which has a component of movement extending in the direction of the advancing yarn, so that the air stream generates a tension on the yarn upstream of the yarn conveying nozzle and causes slack to be formed in the advancing yarn between the yarn conveying nozzle and the takeup device, a free space located downstream of the yarn conveying nozzle and laterally to one side of the normal path of travel for receiving an accumulation of the slack in the advancing yarn caused by the air stream, and wherein said nozzle is oriented so that the air stream has a directional component which acts to laterally deflect the advancing yarn from its normal path of travel and into the free space.

2. The apparatus as defined in claim 1 wherein the nozzle bore is oriented so as to form an angle of less than about 30° with the advancing yarn.

3. The apparatus as defined in claim 1 wherein said yarn conveying nozzle comprises a second nozzle bore for generating a second air stream which engages the advancing yarn and which has a component of movement extending in the direction of the advancing yarn.

4. The apparatus as defined in claim 3 wherein the two nozzle bores define a plane which intersects the advancing yarn and also define an angle which is bisected by the advancing yarn when viewed in a direction perpendicular to said plane.

5. The apparatus as defined in claim 4 wherein the yarn conveying nozzle includes a conveying gap through which the yarn advances, with the gap being defined by two opposing sidewalls, and wherein the two nozzle bores open on a common one of the opposing sidewalls.

6. The apparatus as defined in claim 5 wherein the angle defined by the two bores is less than about 60°.

7. The apparatus as defined in claim 6 wherein said plane intersects the advancing yarn at an angle which is less than about 30°.

8. The apparatus as defined in claim 1 further comprising a rotatably driven conveying roll positioned in the yarn path upstream of the yarn conveying nozzle such that the yarn partially loops about the circumference of the conveying roll.

9. The apparatus as defined in claim 8 wherein the conveying roll is rotatably driven by a turbine drive or an electric drive.

10. The apparatus as defined in claim 8 wherein the conveying roll is rotatably driven by an air turbine drive, and wherein the air turbine drive and the yarn conveying nozzle are connected to a common compressed air supply.

11. The apparatus as defined in claim 10 wherein the at least one nozzle bore is located immediately downstream of the point of departure of the yarn from the conveying roll.

12. The apparatus as defined in claim 1 wherein the yarn conveying nozzle includes a conveying gap through which the yarn advances, with the gap being defined by two opposing sidewalls, and wherein the at least one bore is arranged in one of the sidewalls and opens into said gap.

13. The apparatus as defined in claim 12 wherein the at least one nozzle bore defines a center axis which forms an angle with the opposite sidewall which is less than about 30°.

14. The apparatus as defined in claim 13 further comprising a guide plate fixed to one of the opposing sidewalls so as to extend outwardly from one side of the gap in the direction of the advancing yarn.

15. The apparatus as defined in claim 14 wherein the guide plate is arcuately curved in a direction away from the gap.

16. The apparatus as defined in claim 1 further comprising a bounce plate positioned downstream of the yarn conveying nozzle so as to define the free space therebetween.

17. The apparatus as defined in claim 1 wherein the yarn processing device comprises means for texturing the advancing yarn.

18. A yarn processing apparatus comprising a yarn processing device through which the yarn is advanced, a feed system for withdrawing the advancing yarn from the processing device and conveying the yarn to a takeup device, a yarn conveying nozzle located between the feed system and the takeup device and comprising a conveying channel through which the yarn advances, with the channel being defined by two opposing channel sidewalls, and wherein two nozzle bores open on respective ones of the opposing channel sidewalls for generating intersecting air streams which engage the advancing yarn and which have a component of movement extending in the direction of the advancing yarn, so that the air streams generate a tension on the yarn upstream of the yarn conveying nozzle and causes slack to be formed in the advancing yarn between the yarn conveying nozzle and the takeup device, and a free space located downstream of the yarn conveying nozzle for receiving an accumulation of the slack in the advancing yarn caused by the air stream.

19. The apparatus as defined in claim 18 wherein the two nozzle bores define a plane which contains the advancing yarn and also define an angle which is bisected by the advancing yarn when viewed in a direction perpendicular to said plane.

20. The apparatus as defined in claim 19 wherein the conveying channel is of U-shape in transverse cross section and wherein the sidewalls are substantially parallel to each other.

* * * * *

UNITED STATES PATENT AND TRADEMARK OFFICE

CERTIFICATE OF CORRECTION

PATENT NO. : 6,421,891 B2
DATED : July 23, 2002
INVENTOR(S) : Bartkowiak et al.

It is certified that error appears in the above-identified patent and that said Letters Patent is hereby corrected as shown below:

Title page,
Item [56], References Cited, U.S. PATENT DOCUMENTS, insert the following:

| | | | |
|---|---|---|---|
| -- | 3,323,754 | 6/1967 | Nixdorf et al. |
| | 3,669,328 | 6/1972 | Castelli |
| | 3,908,917 | 9/1975 | Tschentscher --. |

FOREIGN PATENT DOCUMENTS, insert the following:

| | | | |
|---|---|---|---|
| -- | GB | 2092188 | 8/1982 |
| | EP | 0633213 | 1/1995 |
| | DE | 2030343 | 12/1970 |
| | DE | 2254736 | 5/1974 --. |

Signed and Sealed this

Twenty-eighth Day of October, 2003

JAMES E. ROGAN
*Director of the United States Patent and Trademark Office*